US005217217A

United States Patent [19]

Matsumoto

[11] Patent Number: 5,217,217

[45] Date of Patent: Jun. 8, 1993

[54] PAPER FEEDING DEVICE FOR FEEDING PAPER IN LONGITUDINAL AND LATERAL DIRECTIONS

[75] Inventor: Manabu Matsumoto, Nara, Japan

[73] Assignee: Sharp Kabushiki Kaisha, Osaka, Japan

[21] Appl. No.: 872,159

[22] Filed: Apr. 22, 1992

[30] Foreign Application Priority Data

Apr. 22, 1991 [JP] Japan ..... 3-90312

[51] Int. Cl.[5] ..... G03G 21/00; G03G 15/00; B65H 3/44

[52] U.S. Cl. ..... 271/9; 355/308; 355/311

[58] Field of Search ..... 355/308, 309, 311; 271/9, 145

[56] References Cited

U.S. PATENT DOCUMENTS

| | | | |
|---|---|---|---|
| 5,003,493 | 3/1991 | Okada et al. | 355/311 X |
| 5,028,042 | 7/1991 | Yamada et al. | 271/9 |
| 5,052,671 | 10/1991 | Matsuo | 271/9 |
| 5,065,995 | 11/1991 | Iwamoto et al. | 271/9 |
| 5,071,111 | 12/1991 | Iwamoto et al. | 271/145 |
| 5,076,561 | 12/1991 | Matsuo | 271/9 |
| 5,100,122 | 3/1992 | Noda et al. | 271/145 X |

FOREIGN PATENT DOCUMENTS

| | | |
|---|---|---|
| 0397477 | 11/1990 | European Pat. Off. . |
| 58-107551 | 6/1983 | Japan . |

OTHER PUBLICATIONS

Patent Anstracts of Japan vol. 014, No. 233 (P1049) May 17, 1990 of JP-A-2 058 068 (KONICA) Feb. 27, 1990.

*Primary Examiner*—Fred L. Braun

[57] ABSTRACT

A paper feeding device, used in a copier, has a swivel cassette capable of turning to a longitudinal feed position for longitudinal paper feed and to a lateral feed position for lateral paper feed. The paper feeding device is so arranged that the swivel cassette is automatically turned to a priority-given position when power is turned on, auto clear is executed or an all clear key is depressed. The paper feeding device has a memory for storing the number of sheets supplied from a respective one of the feed positions of the swivel cassette. A paper feed position used high frequency is regarded as the priority-given position by comparing the stored numbers with each other, so that the swivel cassette is set to the paper feed position used high frequency when power is turned on, auto clear is executed or the all clear key is depressed. Accordingly, the user can save the trouble of changing over to that feed position used with high frequency, and this feature improves the convenience of the copier.

8 Claims, 9 Drawing Sheets

PAPER FEEDING DEVICE FOR FEEDING PAPER IN LONGITUDINAL AND LATERAL DIRECTIONS

BACKGROUND OF THE INVENTION

1. Field of the Invention

This invention relates to a paper feeding device for feeding paper of different sizes in length and breadth in a longitudinal or lateral direction as one pleases, and more particularly to a paper feeding device with a swivel cassette rotatable to a lateral feed position and a longitudinal feed position.

2. Description of the Related Art

Normally, copiers are provided with a paper feeding device for feeding paper accommodated in a paper cassette. Among the copiers, there is a type which can select by a command of the copier main body whether paper should be fed longitudinally or laterally when paper of different lengths and breadths, such as A4 size and letter size, is used, which is very common, indeed. Here, lateral feed means feeding paper with its one longer side positioned as its top along the paper feeding direction, while longitudinal feed means feeding paper with its one shorter side positioned as its top along the paper feeding direction. Change-over between longitudinal feed and lateral feed is done by turning the swivel cassette to the longitudinal or lateral feed position. The lateral feed position of the swivel cassette is a position of the cassette which enables lateral feed of paper, and the longitudinal feed position is a position of the cassette which enables longitudinal feed of paper. The lateral and longitudinal feed positions of the swivel cassette are 90° apart. This kind of paper feeding device does not require separate cassettes for lateral feed and longitudinal feed, nor does it require the cassette to be changed. This paper feeding device can switch over longitudinal and lateral feed of paper, and therefore, is very convenient.

In a copier with a conventional swivel cassette, when the power switch is turned on or after passage of a fixed time with the copier kept in standby condition, the swivel cassette is turned to a preset feed position to which priority has been given, namely, predetermined on of the longitudinal and lateral feed positions.

Meanwhile, the frequently used feed position differs with the copiers. If the frequently used feed position differs from the priority-given feed position preset in the initial state, when power is turned on or after a certain time has elapsed while the copier was kept in standby position, the cassette is in a feed position used with low frequency. Therefore, if one wishes to use the cassette set in the frequently used position, he has to reset the swivel cassette to that desired feed position though that feed position is used with high frequency. This is very troublesome and reduces the convenience of the copier.

SUMMARY OF THE INVENTION

It is therefore an object of the present invention to provide a paper feeding device capable of feeding paper longitudinally and laterally with enhanced convenience.

Another object of the present invention is to provide a paper feeding device which does not require the paper feed position to be changed when one wishes to feed paper at the paper feed position which is used with high frequency.

Further object of the present invention is to provide a paper feeding device which automatically turns the swivel cassette to the highly frequently used paper feed position when power is turned on or after passage of a fixed time while the copier is kept is standby condition.

These and other objects of the invention can be achieved by a paper feeding device for feeding paper in longitudinal and lateral directions, comprising: a swivel cassette for accommodating paper and being capable of turning to a longitudinal feed position for longitudinal paper feed and a lateral feed position for lateral paper feed; turning means for turning the swivel cassette; conveying means for taking paper from the swivel cassette and conveying the paper; memory means for storing the number of sheets supplied from the swivel cassette at longitudinal feed position and the number of sheets supplied from the swivel cassette at lateral feed position; deciding means for deciding a priority-given position of the swivel cassette according to the number of sheets supplied from the swivel cassette at longitudinal feed position and the number of sheets supplied from the swivel cassette at lateral feed position, those numbers of sheets being stored in the memory means; and control means for controlling the turning means to position the swivel cassette to the priority-given position in response to a decision of the deciding means.

The deciding means decides as a priority-given position of the swivel cassette a paper feed position having a greater number of sheets supplied out of the number of sheets supplied from the swivel cassette at longitudinal feed position and the number of sheets supplied from the swivel cassette at lateral feed position.

The deciding means may include a comparing means which compares the number of sheets supplied from the swivel cassette at longitudinal feed position with the number of sheets supplied from the swivel cassette at lateral feed position.

The control means may include detection means for detecting the present position of the swivel cassette and may be arranged to maintain the present position of the swivel cassette when the present position of the swivel cassette agrees with the priority-given position.

In the paper feeding device according to the present invention, the paper feed position used with high frequency is set as the priority-given paper feed position, so that no operation is required to change the paper feed position when one wishes to feed paper from the paper feed position used with high frequency, which saves time and labor and contributes to improving the convenience of the machine.

Further objects and advantages of the present invention will be apparent from the following description of the preferred embodiment of the invention as illustrated in the accompanying drawings.

DESCRIPTION OF THE PREFERRED EMBODIMENTS

Figure 4:
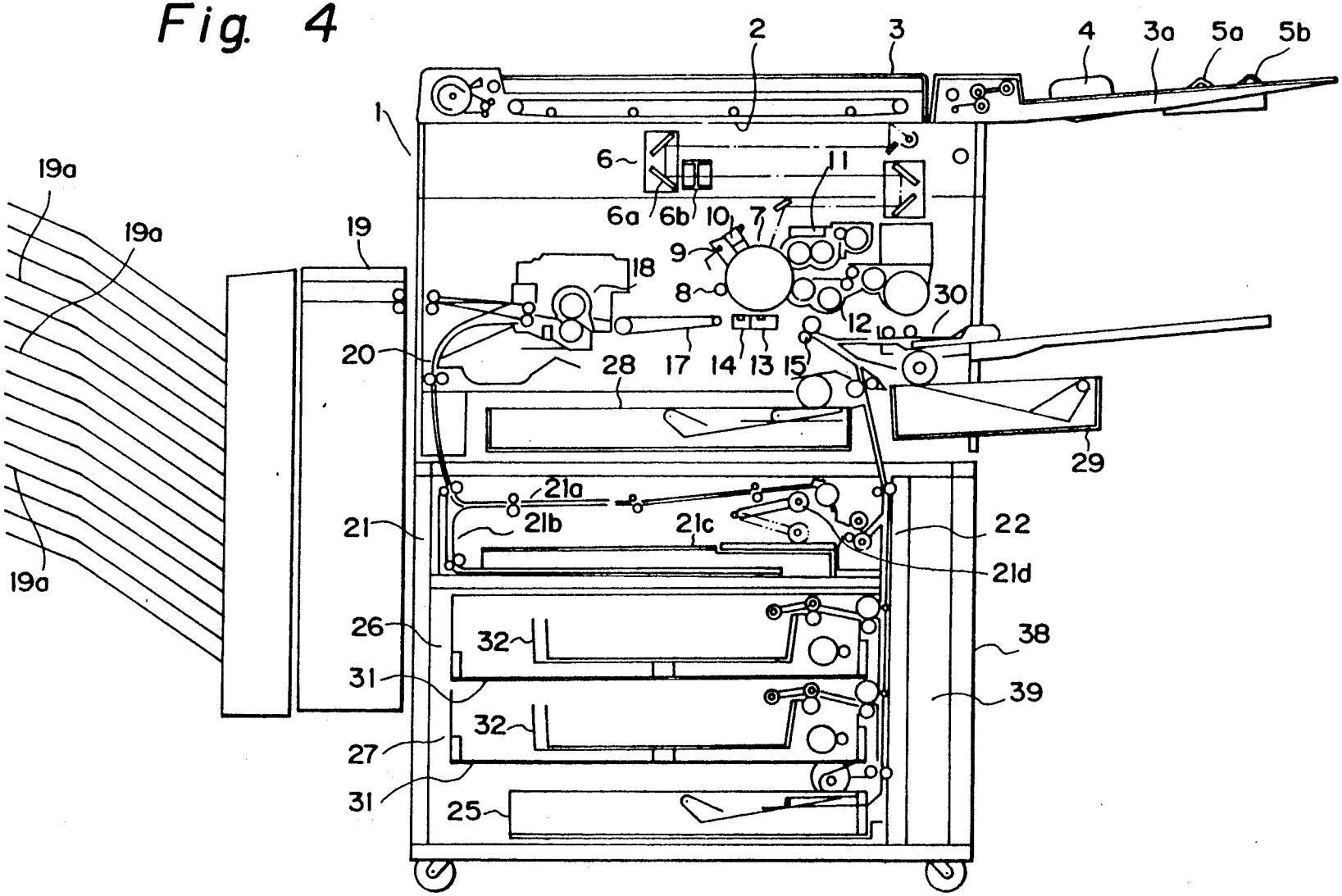
FIG. 4 is a diagram showing a schematic construction of a copier comprising a paper feeding device according the present invention.
Figure 5:
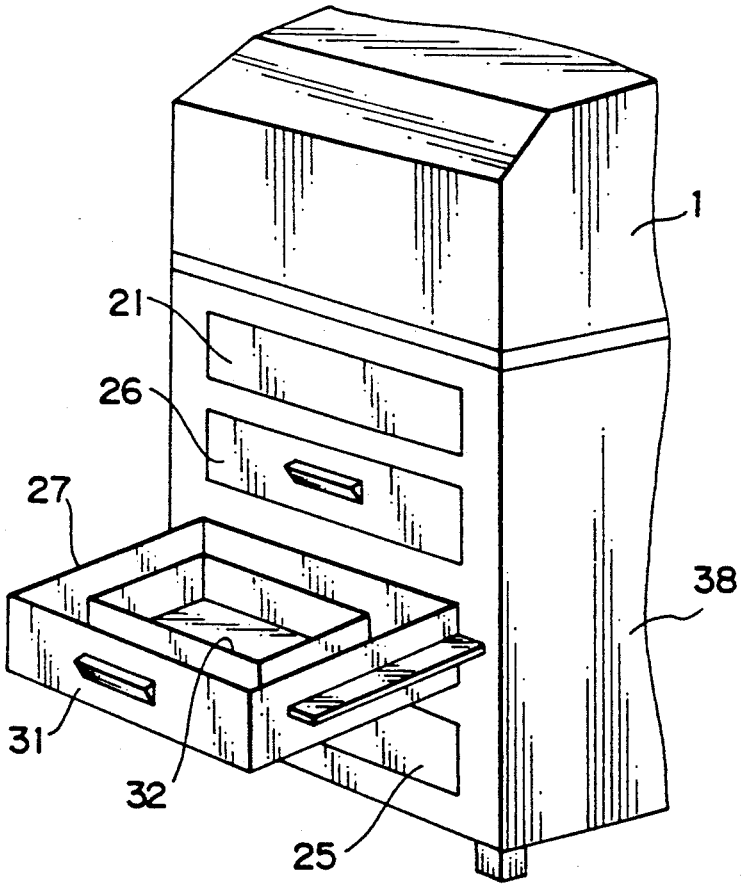
FIG. 5 is a perspective view showing a second swivel cassette drawn out shown in FIG. 4.

An embodiment of the present invention will be described with reference to the accompanying drawings. As shown in FIG. 4, this copier has a desk section 38 below a copier main body 1, a sorter 19 on the paper discharge side of the copier main body 1, and an original document automatic feeding device (hereafter referred to as AFD) on the copier main body 1. As shown in FIG. 5, the above-mentioned desk section includes a duplex synthesizing unit 21, a first swivel cassette unit 26, a second swivel cassette unit 27, and a third fixed cassette 25 in the mentioned order from the top. The first and second swivel cassettes 26 and 27 each includes a swivel cassette 32, which can swivel, contained in an outer box 31.

On a document mounting plate 3*a* of AFD 3, there are provided conveying-direction switches 5*a* and 5*b* for detecting the document size in the conveying direction, and a guide 4 for regulating both sides in the breadth direction of document. This guide 4 has provided thereon breadth-direction switches, not shown, for detecting the document size in the breadth direction. Below a document mounting glass 2, there is provided an optical system 6, having multiple reflecting mirrors 6*a* and multiple lens 6*b*, for performing a basic operation to guide a reflected light from the document to a photosensitive drum 7, and making copies with variable magnification, enlarges and reduced, as well as equal-size copies. Around the photosensitive drum 7, there are arranged a cleaner 8, a static eliminating lamp 9, an electric charger 10, a developing device 11 having toner for color copying, and a developing device 12 having black toner. Below the photosensitive drum 7, there are arranged an image transfer 13 and a separating charger 14. A conveying belt 17 and a fixing device 18 are provided in the paper conveying direction of the photosensitive drum 7.

The paper that has gone through the fixing device 18 basically passes through the sorter 19, and is discharged to a paper tray 19*a*. In the case of duplex copying or synthesizing copying, the paper is guided through the paper return path 20 to the duplex synthesizing unit 21, then in the case of duplex copying, the paper is passed through a first conveying path 21*a*, an intermediate tray 21*c*, and a send-out roller 21*d* in the duplex synthesizing unit 21, and sent out to a paper conveying path 22. On the other hand, in the case of synthesizing copying, the paper is passed through a second conveying path 21*b*, the first conveying path 21*a*, the intermediate tray 21*c* and the send-out roller 21*d* in the duplex synthesizing unit 21, and sent out to the paper conveying path 22. The final end of the paper conveying path 22 extends to the paper stop roller 15 near the photosensitive drum 7.

To the paper conveying path 22, a plurality of paper feeding means are connected, from which paper is supplied as required. More specifically, the above-mentioned paper feeding means includes a manual feed part 30, a first fixed cassette 29 for accommodating, for example, up to 500 sheets, a second fixed cassette 28, the duplex synthesizing unit 21, the first swivel cassette unit 26, the second swivel cassette unit 27 and a third fixed cassette 25 for accommodating, for example, up to 250 sheets, listed in the order of shorter paper conveying routes for conveying paper to the paper stop roller 15 of the copier main body 1. A group of cassettes of a paper feeding device 39 are formed by the first fixed cassette 29 and the second fixed cassette 28 in the copier main body 1, and the first swivel cassette unit 26, the second swivel cassette unit 27 and the third fixed cassette 25 in the desk section 38. The above-mentioned fixed cassettes 29, 28, and 25, and swivel cassettes 26 and 27 are mounted detachably to the copier.

Figure 6A:
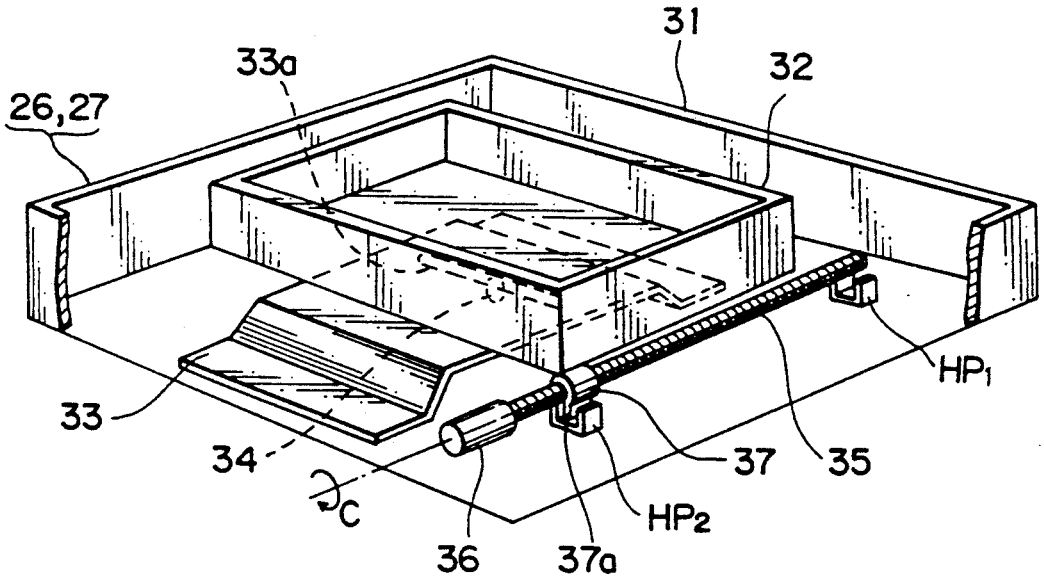
FIG. 6*a* is a perspective view, partially in section, of a unit of the first and second swivel cassettes shown in FIG. 4.
Figure 6B:
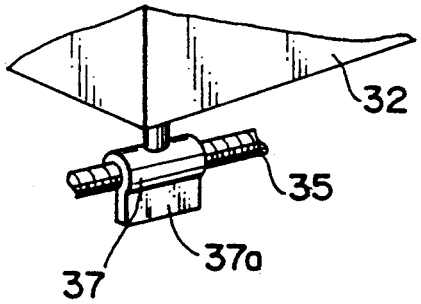
FIG. 6*b* is an enlarged perspective view of a portion near the nut member shown in FIG. 6*a;*

As shown in FIG. 6*a*, the first and second swivel cassette units 26 and 27 are provided respectively in outer boxes 31, and the cassette units each contains a swivel cassette 32 for accommodating paper of a predetermined size. The swivel cassette 32 has a rotating plate, not shown, which raises the sheets of paper in the swivel cassette 32 according to the decrease of paper. On the bottom wall of the outer box 31, a cassette support plate 33 is provided, the center portion of which is spaced from the bottom wall of the outer box 31. In the center portion of the cassette support plate 33, a guide hole 33*a* is formed as a long hole extending in the feeding direction of paper. At the center of the underside of the swivel cassette 32, a guide shaft 34 is provided extending downward, the guide shaft 34 being engaged into the above-mentioned guide hole 33*a*. In the outer box 31, a screw rod 35 is arranged to be parallel with the bottom wall of the outer box 31 at right angle with the direction of paper feed from the swivel cassette 32. This screw rod 35 is supported rotatably by bearings, not shown, and can be rotated in clockwise and counterclockwise directions as this screw rod 35 is connected at one end to a cassette turning motor 36. The screw rod 35 has engaged thereon a nut member 37 which moves back and forth in the axial direction by the clockwise and counterclockwise rotation of the screw rod 35. As shown in FIG. 6*b*, the nut member 37 has a top end thereof connected rotatably to one corner of the swivel cassette 32. A dowser 37*a* is formed at the underside of the nut member 37.

On the other hand, on the bottom wall of the outer box 31 below near the opposite ends of the screw rod 35, there are provided a lateral feed position sensor $HP_1$ for detecting the swivel cassette 32 which has been turned to a specified lateral feed position and a longitudinal feed position sensor $HP_2$ for detecting the swivel cassette 32 which has been moved to the longitudinal feed position, each of those feed position sensors comprising a photo interrupter formed by a light emitting element and a light detecting element. The position sensors $HP_1$ and $HP_2$ are arranged to sense that the swivel cassette 32 has moved to the specified positions by the interruption of light from the light emitting element to the light detecting element by the dowser 37*a*. The above-mentioned lateral and longitudinal feed position sensors $HP_1$ and $HP_2$ are not limited to the photo interrupters, but may be magnetic sensors or contact type switches.

Figure 7A:
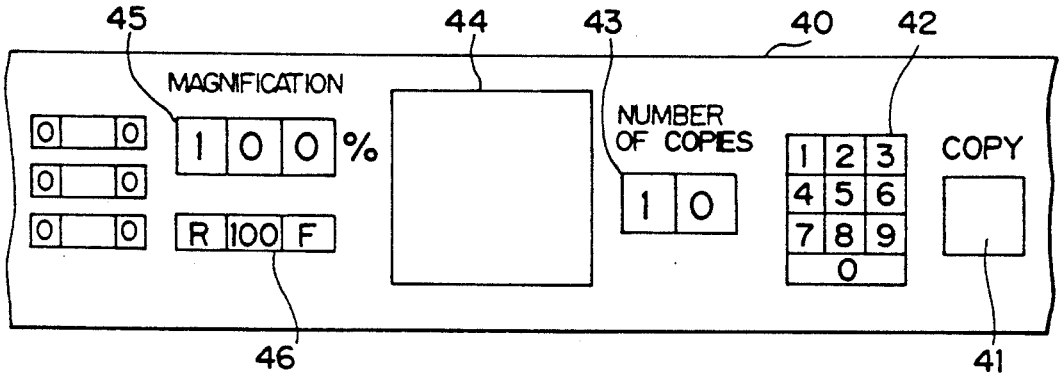
FIG. 7*a* is a front view of the operation panel.
Figure 7B:
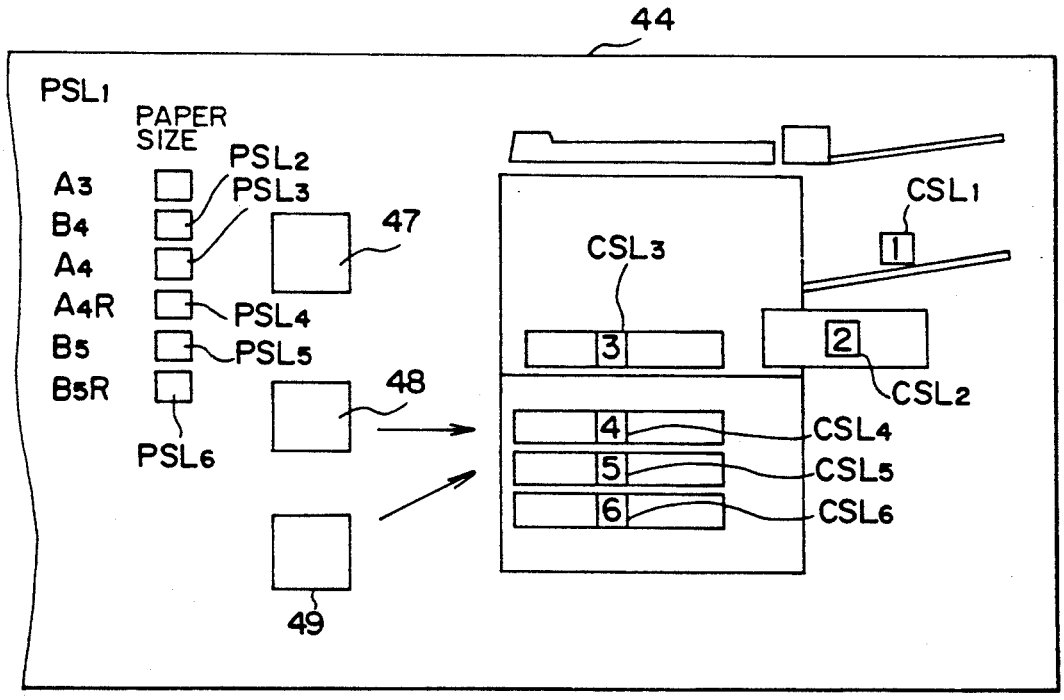
FIG. 7*b* is a front view of the cassette operation section on the operation panel.

The copier main body 1 has an operation panel 40 as shown in FIG. 7*a*. This operation panel 40 comprises a copy button 41 for specifying that a copying operation should be started, a ten-key pad 42 for setting the number of copies, a display 43 of the number of copies, a cassette operation section 44, a magnification display 45, and a magnification setting key 46. As shown in FIG. 7*b*, the above-mentioned cassette operation section 44 includes a cassette change-over key 47 for cassette selection 47; a cassette turning key 48 for specifying that the swivel cassette 32 of the first swivel cassette unit 26 should be turned, and a cassette turning key 49 for specifying that the swivel cassette 32 of the second swivel cassette unit 27 should be turned.

The cassette operation section 44 includes paper size display lamps $PSL_1$ to $PSL_6$ and cassette display lamps $CSL_1$ to $CSL_6$ for indicating the manual feed part 30, the first fixed cassette 29, the second fixed cassette 28, the first swivel cassette unit 26, the second swivel cassette unit 27, and the third fixed cassette 25 with numbers 1 to 6 in that order.

One of the cassette display lamps $CSL_1$ to $CSL_6$ lights up when the cassette change-over key 47 is operated and the corresponding one of the swivel cassette units 26 and 27, the fixed cassettes 25, 28 and 29, and the manual feed part 30 is selected.

For example, when the cassette change-over key 47 is operated and the first swivel cassette unit 26 is selected, the cassette display lamp $CSL_4$ lights, and if paper of A4 size exists in the swivel cassette 32 of the first cassette unit 26, the paper size display lamp $PSL_3$ to indicate the accommodated paper is A4. Then, if the cassette turning key 48 is operated, the swivel cassette 32 turns from the lateral feed position to the longitudinal feed position, and the paper size display lamp $PSL_4$ light to indicate that the paper is A4R.

If paper does not exist in the swivel cassette units 26 and 27, the fixed cassettes 25, 28, and 29, and the manual feed part 30, the corresponding lamp does not light among the paper size display lamps $PSL_1$ to $PSL_6$.

Figure 8:
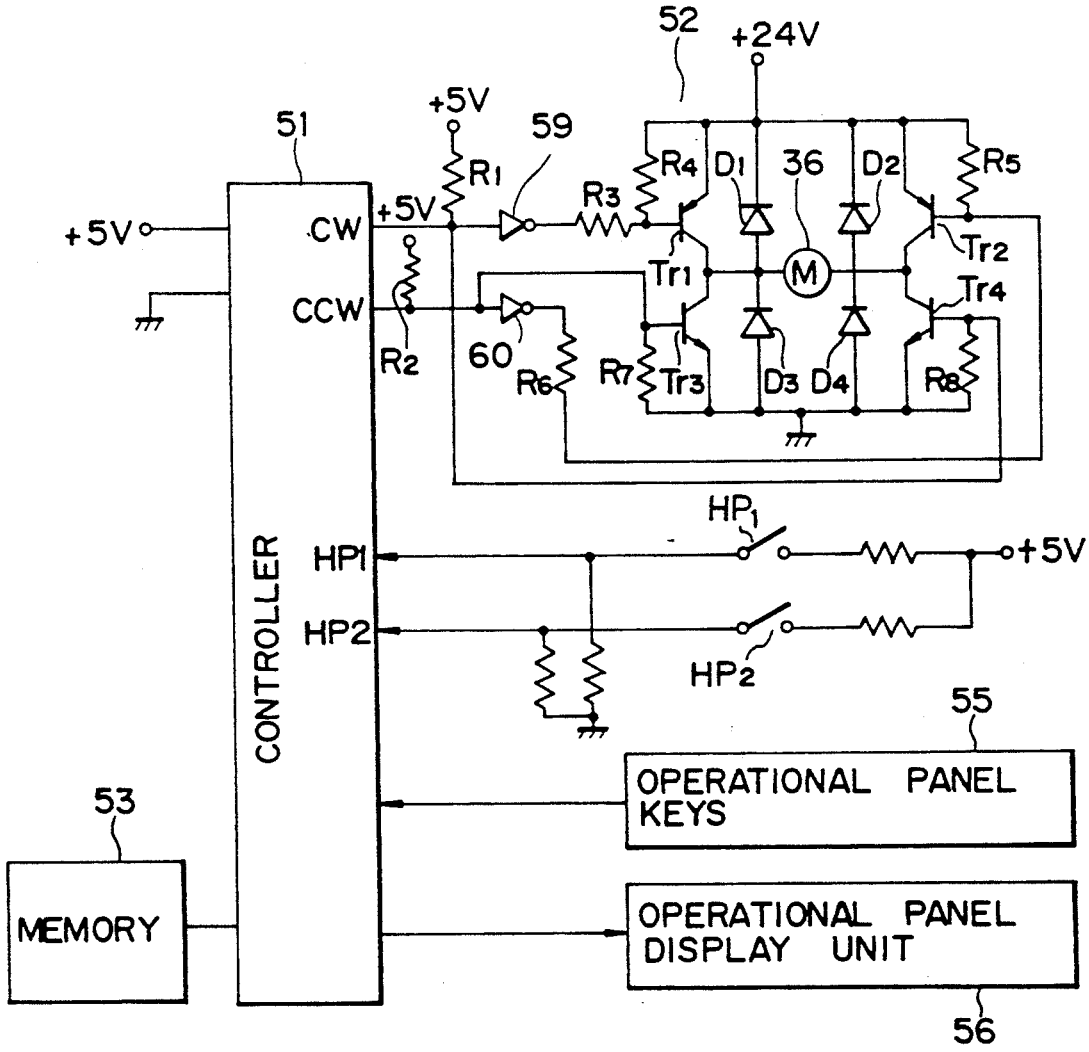
FIG. 8 is a circuit block diagram of the controller.

As shown in FIG. 8, the copier has a controller 51 as control means. The items connected to the controller 51 include a motor driver circuit 52, lateral and longitudinal feed position sensors $HP_1$, $HP_2$, an operation panel keys 55, an operation panel display unit 56, a memory 53 as memory means. A paper feeding device 39 is constituted by the first to third fixed cassettes 29, 28, and 25, the first and second swivel cassette units 26 and 27, means for taking paper from those means and conveying the paper, the controller 51, the motor driver circuit 52, the cassette turning motor 36, and the memory and other means.

The above-mentioned motor drive circuit 52 and the cassette turning motor 36 are provided for each of the first and second swivel cassettes 26 and 27. The motor driver circuit 52 includes pull-up resistors $R_1$, $R_2$, NOT circuits 59, 60, transistors $Tr_1$ to $Tr_4$, resistors $R_3$ to $R_8$, and diodes $D_1$ to $D_4$ as surge absorbers. The motor driver circuit 52 drives the cassette turning motor 36 in clockwise and counterclockwise directions according to output from the controller 51.

The above-mentioned resistor $R_1$, the input side of NOT circuit 59, the base of the transistor $Tr_4$ are connected with an output terminal CW, while the output side of NOT circuit 59 is connected through the resistor $R_3$ to the base of the transistor $Tr_1$. One end of the resistor $R_4$ is connected to the base of the transistor $Tr_1$, one end of the transistor $R_5$ is connected to the base of the transistor $Tr_2$, and the other ends of the resistors $R_4$ and $R_5$, the emitters of the transistors $Tr_1$ and $Tr_2$, and the cathodes of the diodes $D_1$ and $D_2$ are tied together. To the junction point, a voltage of +24 V is applied. The collector of the transistor $Tr_1$ and the anode of the diode $D_1$ are connected to one terminal of the cassette turning motor 36, while the collector of the transistor $Tr_2$ and the anode of the diode $D_2$ are connected to the other terminal of the cassette turning motor 36.

On the other hand, the pull-up resistor $R_2$, the input side of NOT circuit 60, and the base of the transistor $Tr_3$ are connected with an output terminal CCW of the controller 51, while the output side of NOT circuit 60 is connected through the resistor $R_6$ to the base of the transistor $Tr_2$. One end of the resistor $R_7$ is connected to the base of the transistor $Tr_3$, one end of the resistor $R_8$ is connected to the base of the transistor $Tr_4$, and the other ends of the resistors $R_7$ and $R_8$, the emitters of the transistors $Tr_3$ and $Tr_4$, and the anodes of the diodes $D_3$ and $D_4$ are tied together. A voltage of +24 V is applied to the junction point. The collector of the transistor $Tr_3$ and the cathode of the diode $D_3$ are connected to one input terminal of the cassette turning motor 36, while the collector of the transistor $Tr_4$ and the cathode of the diode $D_4$ are connected to the other input terminal of the cassette turning motor 36.

In the above-mentioned motor driver circuit 52, the swivel cassette 32 of the first swivel cassette unit 26 or the second swivel cassette unit 27 is turned to the lateral feed position, i.e. the A4 or B5 position when the output terminal CCW of the controller 51 is at high level (with the output terminal CW set at low level), while the above-mentioned swivel cassette 32 is turned to the longitudinal feed position, i.e. the A4R or A5R position when the output terminal CW is at high level.

The operation panel keys 55 include the copy button 41, ten key pad 42, magnification setting key 46, cassette changeover key 47, and cassette turning keys 48 and 49.

The operation panel display unit 56 includes the display 43 of the number of copies, the magnification display 45, the paper size display lamps $PSL_1$ to $PSL_6$ and the cassette display lamps $CSL_1$ to $CSL_6$, provided on the operation panel 40.

The memory 53 stores the present feed position at which the swivel cassettes 32, 32 of the first and second swivel cassette units 26 and 27 are located. The memory 53 also stores the number of sheets supplied from the paper feed positions of the swivel cassettes 32, 32 in the longitudinal feed position and the lateral feed position.

When each key on the operation panel 55 is operated, the controller 51 performs control of the related operation. For example, when the cassette turning key 48 corresponding to the first swivel cassette unit 26 is operated, if this key operation specifies that the swivel cassette 32 of the first swivel cassette unit 26 should be turned from the lateral feed position to the longitudinal feed position, the output terminal CW is set at high level and the output terminal CCW is set at low level. If the key operation specifies that the above-mentioned swivel cassette 32 should be turned from the longitudinal feed position to the lateral feed position, the output terminal CCW is set to high level and the output terminal CW is set to low level.

If the swivel cassette 32 is moved to the lateral feed position and the lateral feed position sensor $HP_1$ turns on, that is, the light of the photo interrupter is blocked, then the output terminal CCW is immediately set to low level, whereby the cassette turning motor 36 is stopped. On the other hand, if the swivel cassette 32 is moved to the longitudinal feed position and the longitudinal feed position sensor $HP_2$ turns on, then the output terminal CW is immediately set to low level, whereby the cassette turning motor 36 is stopped. The controller 51 performs control actions as shown in FIGS. 1*a*, 1*b*, 2 and 3, which will be described later.

Under the above-mentioned arrangement, description will be made of the turning motion of the swivel cassette 32 with reference to the first swivel cassette unit 26 as an example.

Figure 9:
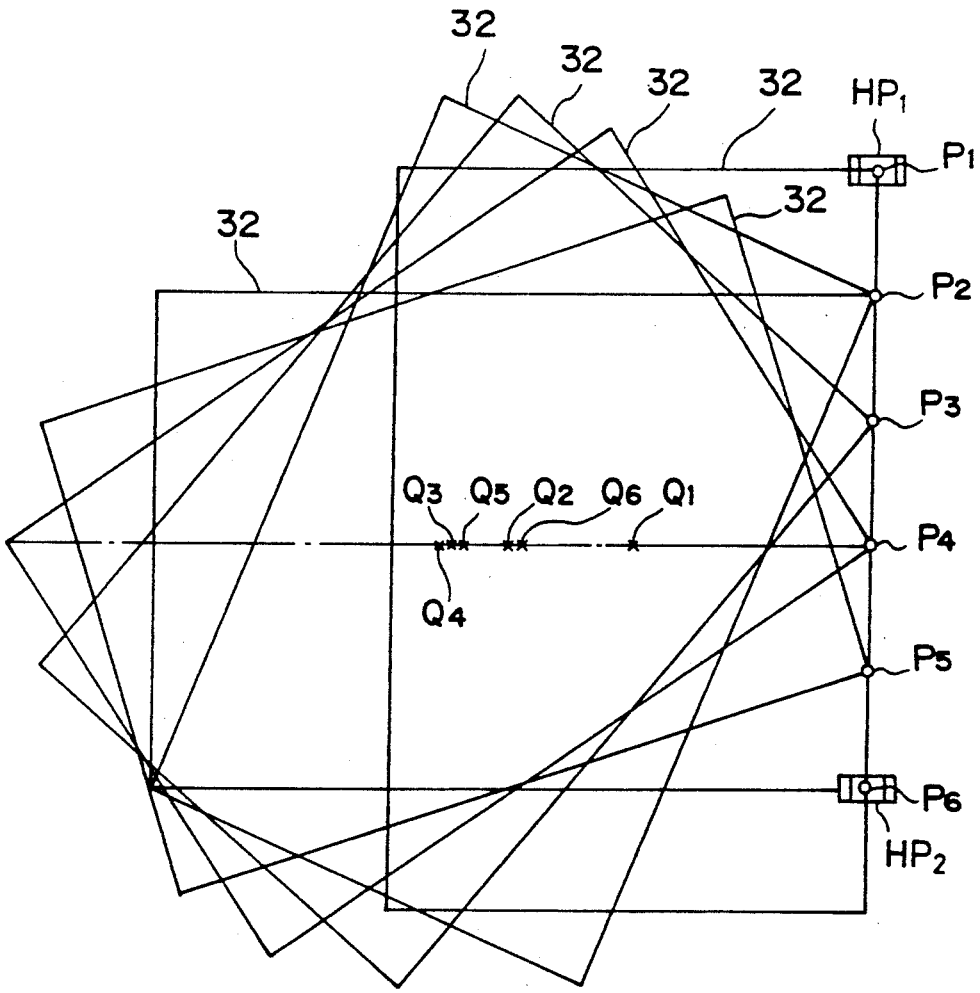
FIG. 9 is an explanatory diagram for explaining the turning process of the swivel cassette.

If paper of A4 size is accommodated in the swivel cassette 32 of the first swivel cassette unit 26 and the swivel cassette 32 is arranged in the lateral feed position (A4 position), the lateral feed position sensor $HP_1$ turns on, and "A4" is displayed as the paper size of the first swivel cassette unit 26 of the operation panel display unit 56. At this time, the nut member 37 engaged to the screw rod 35 is supposed to be at $P_1$ as shown in FIG. 9.

If, at this point, the cassette turning key 48 is operated which corresponds to the first swivel cassette unit 26 and which is included in the operation panel keys 55, the output terminal CW of the controller 51 is set to high level and the output terminal CCW is set to low level. Consequently, the transistors $Tr_1$ and $Tr_4$ turn on, current flows through a route from the +24 V power supply to the transistor $Tr_1$ to the cassette turning motor 36 to the transistor $Tr_4$ and to ground. Therefore, the cassette turning motor 36 rotates in the forward direction (C direction), so that the screw rod 35 rotates in the C direction. The nut member 37 is moved from $P_1$ toward $P_6$, the guide shaft 34 in the swivel cassette 32, while rotating, slides in the guide hole 33*a* of the cassette support plate 33, and moves back and forth in the order of $Q_1$ to $Q_6$. When the nut member 37 reaches the longitudinal feed position sensor $HP_2$ and the longitudinal feed position sensor $HP_2$ turns on, the cassette turning motor 36 stops. Under this condition, the swivel cassette 32 is arranged in the longitudinal feed position (A4R position) as specified.

Under this condition, the cassette turning key 48 is operated again, the output terminal CCW of the controller 51 is set to high level and the output terminal CW is set to low level, the transistors $Tr_2$ and $Tr_3$ turn on, thus causing current to flow through a route from the +24 V power supply to the transistor $Tr_2$ to the cassette turning motor 36 to the transistor $Tr_3$, and to ground, and as a result, the cassette turning motor 36 rotates in reverse direction. Therefore, the swivel cassette 32 moves from the above-mentioned longitudinal feed position, passes through the reverse route, and assumes the lateral feed position. Then, when the lateral feed position sensor $HP_1$ turns on, the cassette turning motor 36 stops, and the swivel cassette 32 is arranged in the lateral feed position as specified.

The main control actions by the controller 51 will be described with reference to the flowcharts of FIGS. 1*a*, 1*b*, 2 and 3.

Figure 1A:
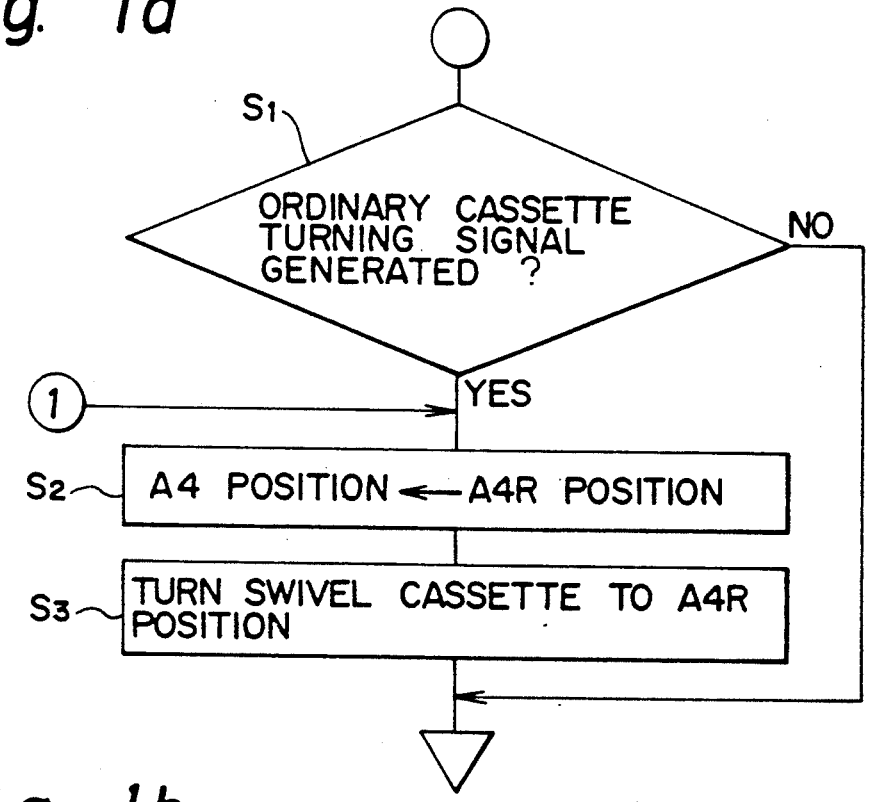
FIG. 1*a* is a flowchart showing the operation to be executed when an ordinary cassette turning signal is generated.

FIG. 1*a* shows the operation when the cassette turning key 48 is operated which corresponds to the first swivel cassette unit 26, for example.

Let us suppose that paper of A4 size is accommodated in the swivel cassette 32 of the first swivel cassette unit 26, and the swivel cassette 32 is arranged in the A4 feed position.

At step S1, a decision is made whether a cassette turning signal has been generated by the cassette turning key 48 having been operated, for example. And, if a cassette swivel signal has not been generated, the process proceeds to stops subsequent to step S3. If a cassette turning signal has been generated at step S1, the feed position stored in the memory is rewritten to A4R (S2), and the swivel cassette 32 of the first swivel cassette unit 26 is turned to the A4R feed position (S3). When the swivel cassette 32 is moved to the A4R feed position, the longitudinal feed position sensor $HP_2$ turns on, by which the user is notified of the arrival of the swivel cassette at the A4R feed position.

Figure 1B:
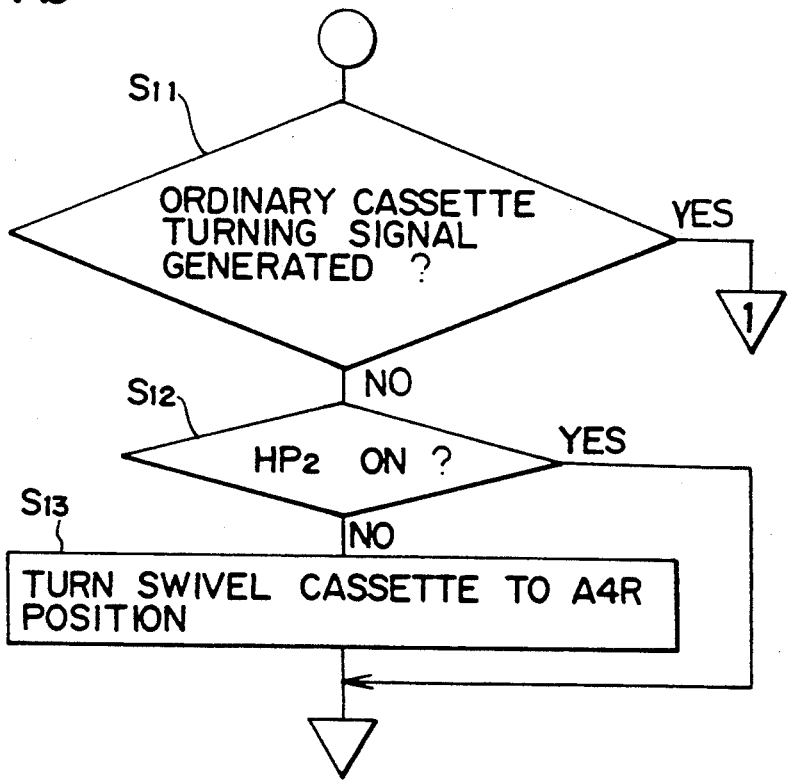
FIG. 1*b* is a flowchart showing the operation to be executed when the swivel cassette is displaced from a feed position.

FIG. 1*b* shows in the paper feed program the action which is taken when the swivel cassette 32 is displaced from the above-mentioned A4R feed position.

When the swivel cassette of the first swivel cassette is located in the A4R feed position, the longitudinal feed position sensor $HP_2$ stays on. If the swivel cassette 32 is displaced from the A4R feed position, the longitudinal feed position sensor $HP_2$ turns off. Therefore, first of all, a decision is made whether a cassette turning signal has been generated (S11), and if a cassette turning signal has not been generated, a decision is made whether the longitudinal feed position sensor $HP_2$ is on (S12). If the longitudinal feed position sensor $HP_2$ is not on, i.e. off, the swivel cassette 32 is turned to the A4R feed position stored in the memory 53 (S13). If a cassette turning signal has been generated at S11, the process moves on to step S2 in FIG. 1*a*.

By control described above, the swivel cassette 32, if displaced from the specified feed position by some external force, it can be returned to the position where it was.

Figure 2:
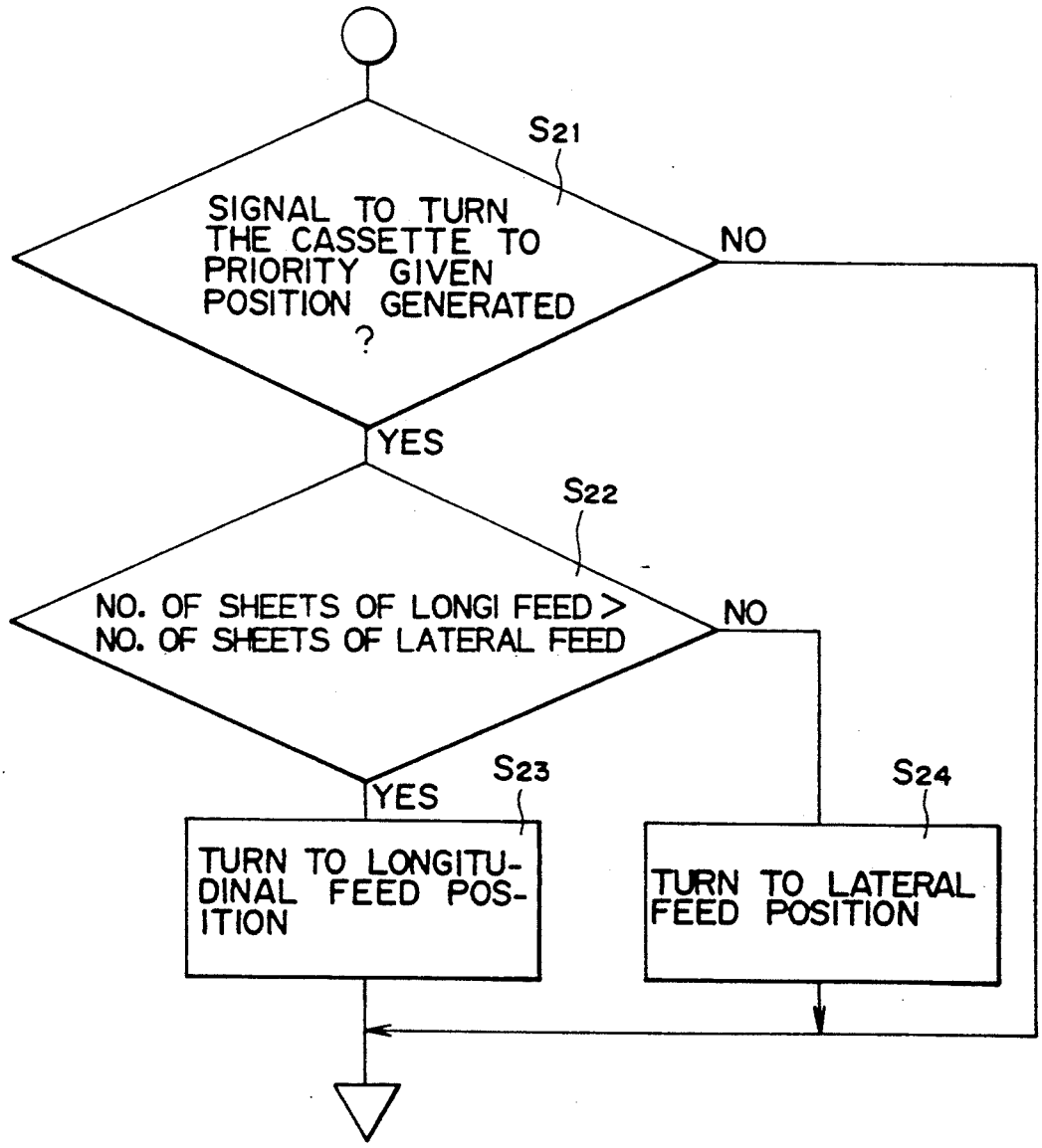
FIG. 2 is a flowchart showing the operation to be executed when a cassette turning signal to turn the cassette to a priority-given paper feed position is generated.

FIG. 2 shows in the paper feed program the action which is taken when a cassette turning signal to the priority-given position is generated. A decision is made whether a cassette turning signal to the priority-given position has been generated (S21), and if not, the process proceeds to steps subsequent to steps S23 and S24. If a cassette turning signal has been generated, the numbers of sheets supplied from the longitudinal feed position and the lateral feed position, stored in the memory 53, and those numbers are compared to find which is greater (S22).

If the number of sheets supplied from the longitudinal feed position is greater than the number of sheets supplied from the lateral feed position, a signal is generated at step S23 which specifies the swivel cassette should be turned to the longitudinal feed position. If the number of sheets supplied from the lateral feed position, a signal is generated which specified the swivel cassette should be turned to the lateral feed position.

In response to a cassette turning signal mentioned above, the cassette position sensors are checked according to a control flow, not shown, and if the sensor which shows a desired position of the swivel cassette has not been turned on, the feed position stored in the memory is rewritten and the swivel cassette is turned.

By control described, the swivel cassette can be set automatically to a paper feed position used with higher frequency.

Figure 3:
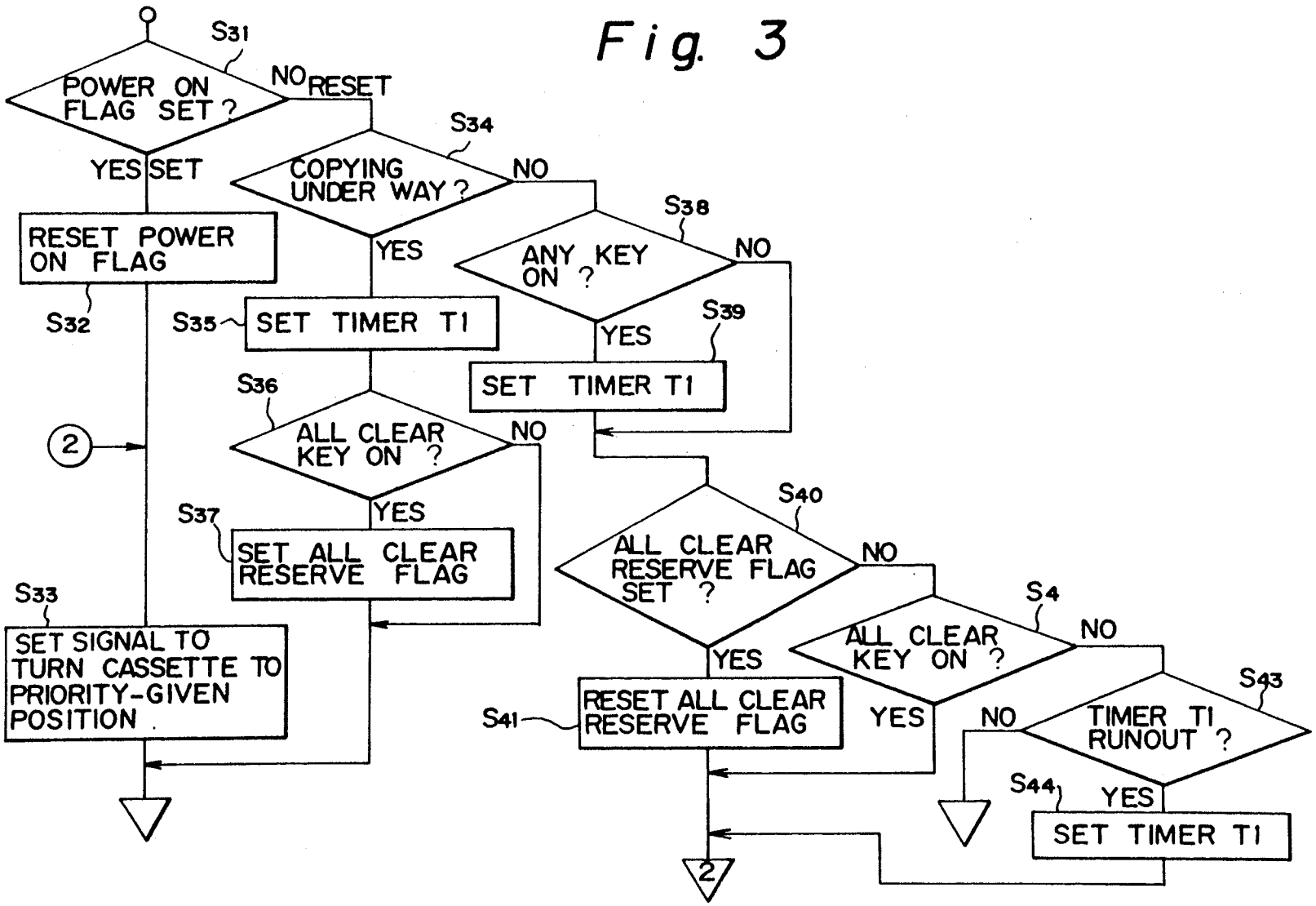
FIG. 3 is a flowchart showing the operation for detecting Power ON, Auto Clear, and depression of an all clear key and generating a cassette turning signal for turning to the priority-given paper feed position.

FIG. 3 is a flowchart showing a setting procedure of a cassette turning signal to a priority-given paper feed position. At step S31, a decision is made whether a power on flag has been set in an initial setting routine (not shown) at the time of power application when power is actually turned on. If the flag has been set, the power on flag is reset at step S32, and a cassette turning signal to a priority-given paper feed position is set at step S33. If the flag has not been set, at step S34 a decision is made whether copying is under way, and if copying is under way, an Auto Clear timer T1 is set at step S35. This timer T1 increments by one at fixed intervals by a time interrupt process (not shown) by CPU.

At step 36, a decision is made whether an all clear key on the operation panel has been pressed which returns the copy mode to standard state, and if the all clear key has been pressed, an all clear reserve flag is set at step 37. If it was found at step S34 that copying is not under way, a decision is made at step S38 whether any key (FIG. 7) on the operation panel has been turned on, and if some key has been turned on, the Auto Clear timer T1 is set again at step S39.

Subsequently, a decision is made at step S40 whether the all clear reserve flag, which is to be set at step S37, has been set, and if so, the flag is reset at S41, and the process moves on to step S33. If not, a decision is made at step S42 whether the all clear key has been turned on, and if the key has been turned on, the process similarly moves on to step S33. If the key has not been turned on, a decision is made at step S34 whether the Auto Clear timer T1 has reached the end of the timer period, and if it has reached the end of the timer period, the timer T1 is set again at step S44, and the process moves on to step S33. If not, the process proceeds to the next routine.

By control as described, the swivel cassettes can be automatically turned to the paper feed position used with higher frequency when power is turned on, Auto Clear is executed or the all clear key is turned on. Therefore, it is possible to save the trouble of turning the cassettes by manipulating the cassette turning keys 48 and 49, thereby enhancing the convenience of the paper feeding device.

Many widely different embodiments of the present invention may be constructed without departing from the spirit and scope of the present invention. It should be understood that the present invention is not limited to the specific embodiments described in the specification, except as defined in the appended claims.

What is claimed is:

1. A paper feeding device for feeding paper in longitudinal and lateral directions, comprising:

a swivel cassette for accommodating paper and being capable of turning to a longitudinal feed position for longitudinal paper feed and a lateral feed position for lateral paper feed;

turning means for turning said swivel cassette;

conveying means for taking paper out of said swivel cassette and conveying the paper;

memory means for storing a number of sheets supplied from the swivel cassette at longitudinal feed position and a number of sheets supplied from said swivel cassette at lateral feed position;

selecting means for selecting a priority position between said longitudinal and lateral positions according to the stored number of sheets supplied from said swivel cassette at longitudinal feed position and the stored number of sheets supplied from said swivel cassette at lateral feed position; and control means for controlling the said turning means to position said swivel cassette to the selected priority position on the basis of a selection of said selecting means.

2. A paper feeding device according to claim 1, wherein said selecting means selects a paper feed position representing the greater number of sheets between the longitudinal feed position and the lateral feed position.

3. A paper feeding device according to claim 1, wherein said selecting means includes means for comparing the number of sheets supplied from said swivel cassette at longitudinal feed position with the number of sheets supplied from said swivel cassette at lateral feed position.

4. A paper feeding device according to claim 1, wherein said control means includes detecting means for detecting a present position of said swivel cassette, and wherein said control means maintains the present position of said swivel cassette when the present position of said swivel cassette coincides with the priority position.

5. A paper feeding device, used in a copier which generates a signal to turn a paper cassette to a priority-given feed position, for feeding paper in longitudinal and lateral directions, comprising:

a swivel cassette for accommodating paper and being capable of turning a longitudinal feed position for longitudinal paper feed and a lateral feed position for lateral paper feed;

turning means for turning said swivel cassette;

conveying means for taking paper out of said swivel cassette and conveying the paper;

memory means for storing a number of sheets supplied from said swivel cassette at longitudinal feed position and a number of sheets supplied from said swivel cassette at lateral feed position;

selecting means for selecting a priority position between said longitudinal and lateral positions according to the stored number sheets supplied from said swivel cassette at lateral feed position; and control means for controlling said turning means to position said swivel cassette to the selected priority position on the basis of a selection of said selecting means when a signal to turn the cassette to the priority-given position has been generated.

6. A paper feeding device according to claim 5, wherein said selecting means selects a paper feed position representing the greater number of sheets between the longitudinal feed position and the lateral feed position.

7. A paper feeding device according to claim 5, wherein said selecting means includes means for comparing the number of sheets supplied from said swivel cassette at longitudinal feed position with the number of sheets supplied from said swivel cassette at lateral feed position.

8. A paper feeding device according to claim 5, wherein said control means includes detection means for detecting the present position of said swivel cassette, and wherein said control means maintains the present position of said swivel cassette when the present position of said swivel cassette coincides with the priority feed position.

* * * * *